US005990770A

United States Patent [19]

Doneghue

[11] Patent Number: 5,990,770

[45] Date of Patent: Nov. 23, 1999

[54] ELECTROMAGNETIC RELAY

[75] Inventor: Jeffrey A. Doneghue, Lawrenceville, Ill.

[73] Assignee: Siemens Electromechanical Components, Inc., Princeton, Ind.

[21] Appl. No.: 09/048,457

[22] Filed: Mar. 26, 1998

[51] Int. Cl.[6] ..... H01H 51/22

[52] U.S. Cl. ..... 335/78; 335/128; 29/622

[58] Field of Search ..... 335/78–86, 128; 29/622, 825

[56] References Cited

U.S. PATENT DOCUMENTS 3,911,383 10/1975 Tabei et al. ..... 335/106

5,781,089 7/1998 Doneghue ..... 335/78

*Primary Examiner*—Lincoln Donovan

*Assistant Examiner*—Tuyen Nguyen

*Attorney, Agent, or Firm*—Mark H. Jay

[57] ABSTRACT

An electromagnetic relay includes a winding, a magnetic core disposed within the winding, and an armature mounted for movement at a first end of the winding. At least one movable circuit contact is operably associated with the armature and movable with respect to at least one stationary contact mounted in the relay responsive to motion of the armature. An end plate is mounted at an opposing end of the winding and an insulating sheet is folded about a portion of the winding. The insulating sheet has first and second sides, with the first side being secured on one end to the end plate, and the second end disposed between the armature and the first end of the winding. An outer frame covers at least a portion of the insulating sheet. The insulating sheet functions to reduce the occurrence of voltage breakdown within the relay.

6 Claims, 4 Drawing Sheets

ELECTROMAGNETIC RELAY

Related Divisional applications 08/754,737 filing date Nov. 21,1996 now U.S. Pat. No. 5,781,089.

BACKGROUND OF THE INVENTION

1. Field of the Invention

The present invention relates to electromagnetic relays and more particularly, to relays having improved voltage breakdown characteristics.

2. Description of the Related Art

A typical electromagnetic relay generally includes a bobbin having a winding, a magnetic core disposed within the winding, and an armature mounted for movement at one end of the winding. A movable contact is typically linked to the armature. Pivot motion of the armature in response to electromagnetic forces produced by the winding and core causes the movable electrical contact to make or break electrical contact with one of a plurality of stationary contacts. As such, electrical connection is selectively made between one of the stationary contacts and a terminal point connected to the movable contact member to perform switching functions.

An exemplary relay of the above-noted type is disclosed in U.S. Pat. No. 5,151,675, assigned to the assignee herein, which is directed to an electromagnetic relay having a contact spring mounted on an armature with improved spring flex to obviate problems of welding or adhesion of the electrical contacts. The improved spring flex is achieved by designing the contact spring with a constricted width near the free edge of the armature and broadening into a T-shaped end to provide a double contact or bridge contact. Also, a pair of supporting tabs are used to transmit a jolt of force to the armature during opening of the contacts to break any welding or adhesion of the contacts.

One problem inherent in the above type of relay is that, due to the typical close proximity of the contacts and the core, there is a possibility of voltage breakdown between the contacts and coil during voltage surges. For example, such voltage surges may occur during lightning storms.

Hence, there is a need for an electromagnetic relay with improved resiliency to voltage surges, and which is of a simple and compact design that is readily manufacturable

SUMMARY OF THE INVENTION

The present invention is directed to an electromagnetic relay having a high degree of tolerance to voltage surges that could otherwise cause voltage breakdown within the relay, and to a method of producing the same. In an illustrative embodiment, the relay includes a winding, a magnetic core disposed within the winding and an armature mounted for movement at a first end of the winding. At least one movable circuit contact is operably associated with the armature and movable with respect to at least one stationary contact mounted in the relay responsive to motion of the armature. An end plate is disposed at an opposing end of the winding and an insulating sheet is folded about a portion of the winding. The insulating sheet has first and second sides, with the first side being secured to the end plate, and the second side disposed between the armature and the first end of the winding. An outer frame covers at least a portion of the insulating sheet. The insulating sheet functions to reduce or eliminate the occurrence of voltage breakdown between the winding and other electrically conductive components of the relay.

Preferably, the end plate includes a plurality of posts protruding from a side portion, and the first side of the insulating sheet has an associated plurality of slits. During the relay assembly, the posts are inserted through the slits to thereby anchor the first side of the insulating sheet to the end plate. Then, the magnetic core, which has a head portion of a larger diameter than the core body, is inserted in the winding, pressing against the second side of the insulating sheet to hold it in place. The armature and frame are then assembled on to the relay, completing an efficient assembly operation.

BRIEF DESCRIPTION OF THE DRAWINGS

For a better understanding of the present invention, reference is had to an exemplary embodiment thereof, considered in conjunction with the accompanying drawings in which like reference numerals designate similar or identical elements, wherein.

DETAILED DESCRIPTION OF THE PREFERRED EMBODIMENT

Figure 1:
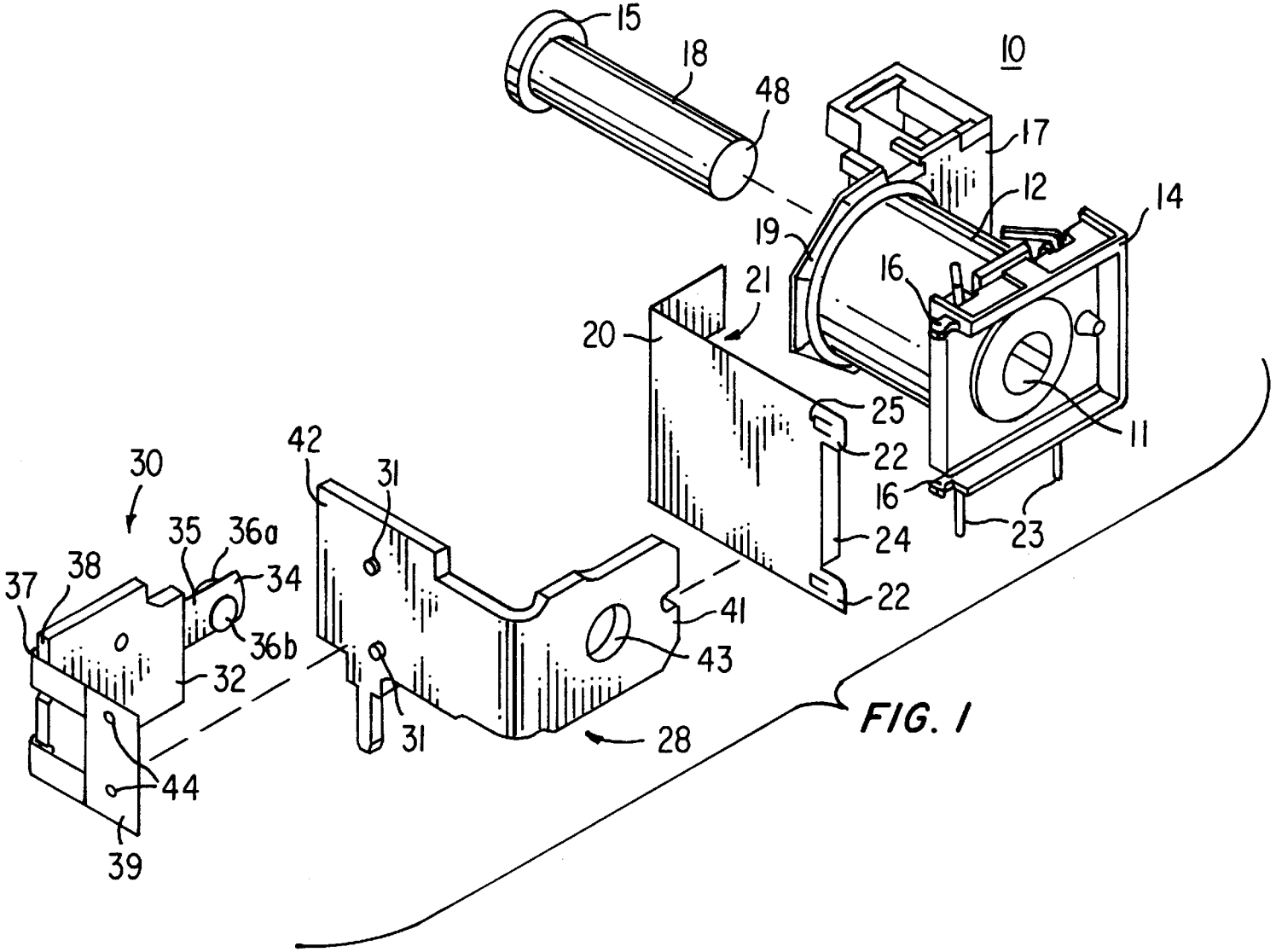
FIG. 1 is an exploded view showing individual components of a relay in accordance with the present invention.

Referring to FIG. 1, an electromagnetic relay 10 in accordance with the present invention includes winding 12 wound about bobbin 11, core 18, contact chamber 17, insulator 20, end plate 14, frame 28 and armature/contact assembly 30. Insulator 20 is a thin, folded sheet of a dielectric material such as Mylar®. Insulator 20 functions to reduce the occurrence of high voltage breakdown or arcing between winding 12 and any electrically conductive components which are proximally disposed to the winding, such as armature/contact assembly 30 or frame 28. The thickness and dielectric constant of insulator 20 must therefore be sufficient to carry out this objective.

Figure 2:
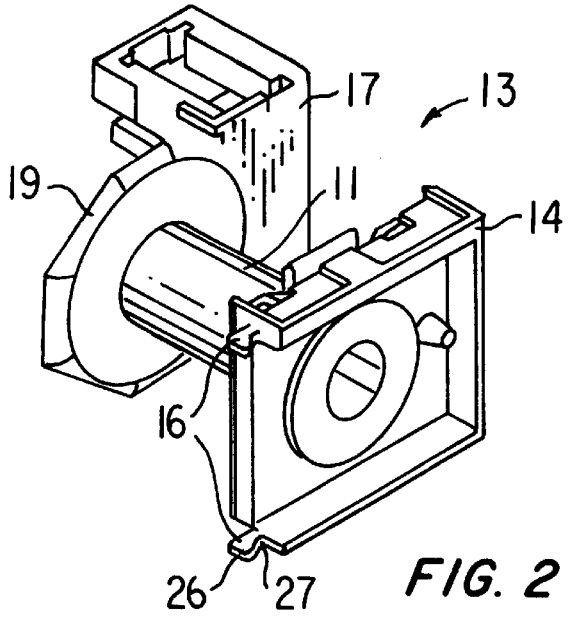
FIG. 2 shows a bobbin assembly used within the relay.
Figure 3:
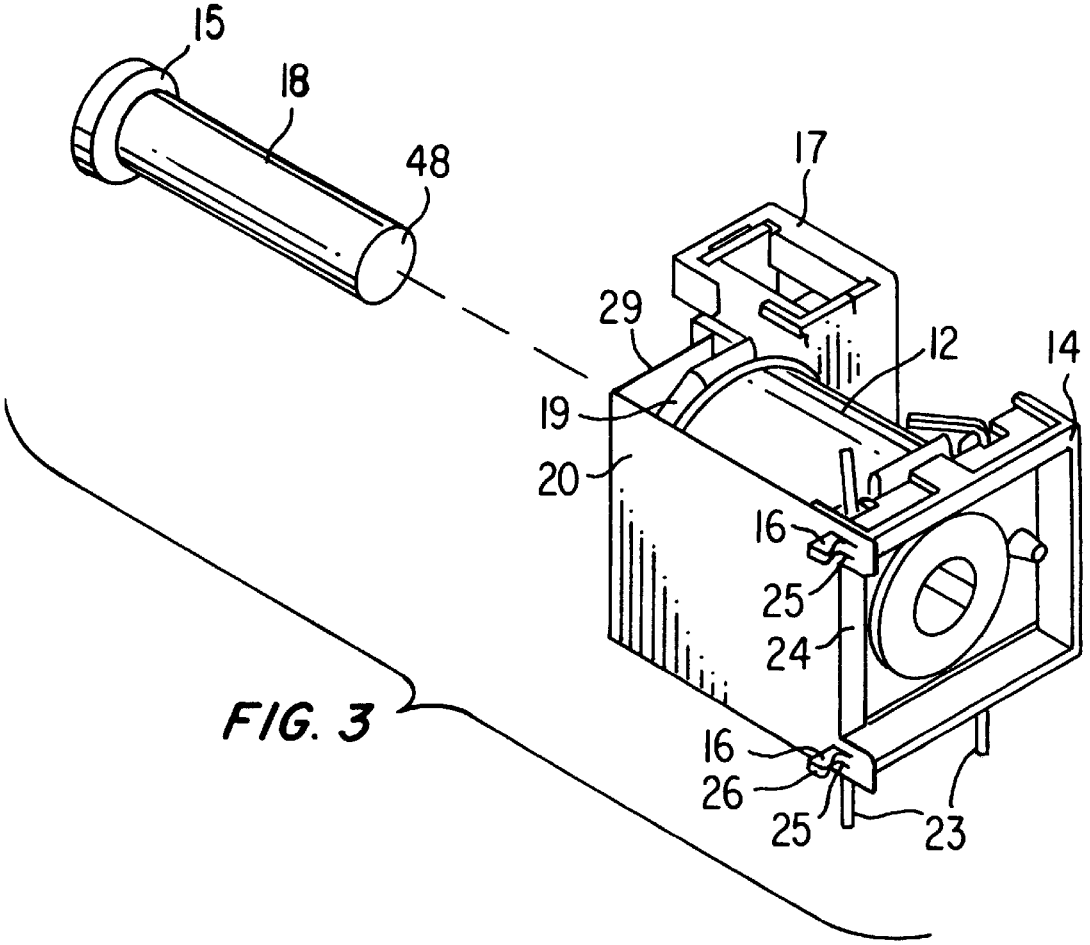
FIG. 3 shows a partial assembly of the relay.

The features of insulator 20 are designed in conjunction with the other relay components to provide an efficient assembly procedure in a high volume manufacture. Referring to FIG. 2, a plastic bobbin assembly 13 is manufactured as a single piece in a mold. Assembly 13 includes bobbin 11, end plate 14 unitary with one end of bobbin 11, contact chamber 17, and L-flange 19 having one side unitary with the second end of bobbin 11 and another side unitary with contact chamber 17. Two bobbin posts 16, each having an arcuate central region 27 and a nibbed portion 26, protrude from upper and lower extremities of a side portion of end plate 14.

Referring again to FIG. 1, assembly of relay 10 is performed by first wrapping winding 12 about bobbin 11 using any suitable technique known in the art. Two mounting pins 23 may then be inserted through corresponding through-bores of end bracket 14. These pins function to facilitate mounting of the completed relay assembly 10 to a higher assembly in the overall system. Optionally, pins 23 could be formed as part of bobbin assembly 13 by slight modification of the mold which defines the bobbin assembly.

Insulator 20 has a pair of U-shaped slits 25 aligned with the bobbin posts 16. Insulator 20 is anchored to end plate 14 adjacent winding 12 by inserting bobbin posts 16 through slits 25—i.e., the insulator is snapped in place over the bobbin posts. This is shown more clearly in FIG. 2. Nibs 26 retain the insulator in place. The spring force of the flaps created by the slits 25 against the arcuate central regions 27 of the posts 16 aids in the retention of insulator 20. The other side 29 of insulator 20 is in a position abutting bracket 19. Flap portion 24 of insulator 20 folds over the side portion of end plate 14. This flap portion functions to reduce the occurrence of voltage breakdown between the frame 28 (to be assembled) and the portion of winding 12 in proximity to end plate 14. Flap portion 24 effectively increases the electrical distance that any arc must travel to cause breakdown between frame 28 and winding 12.

It is noted that insulator 20 can alternatively be secured or anchored to end plate 14 in other ways. For example, two tapped holes can be drilled in the side portion of end plate 14 in place of bobbin posts 16, with two corresponding clearance holes being opened in insulator 20 in place of slits 25 to enable a pair of screws to fasten insulator 20 to the side portion of end plate 14. However, this would require additional parts and is therefore not the preferred approach.

Figure 4:
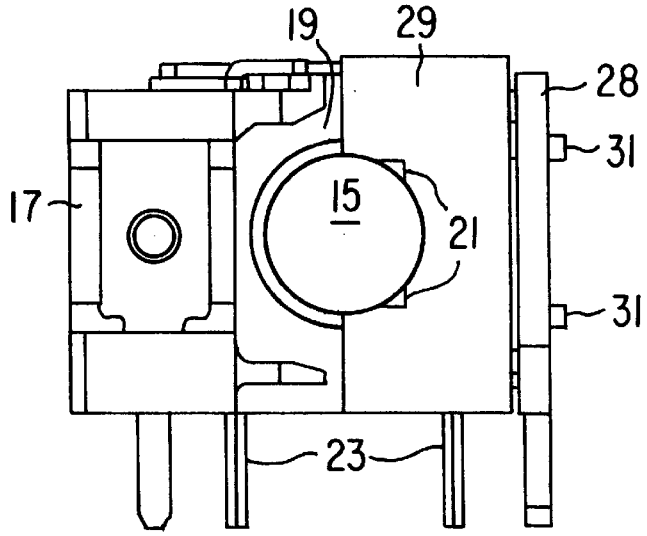
FIG. 4 shows an end view of a partially assembled relay.

The next step in the relay assembly entails inserting the body of core 18 into the hollow central region of bobbin 11. Head 15 of core 18 is of a larger diameter than the body of the core. When fully inserted, head 15 presses against a portion of side 29 of insulator 20, thereby trapping side 29 in place against bracket 19. Core 18 may be secured within bobbin 11 by means of a press fit, for example. Side 29 has a U-shaped cut-out 21 through which the elongated body of core 18 passes through. The width of cut-out 21 is larger than the diameter of the core body and smaller than the head 15 diameter. When core 18 is fully inserted, end portion 48 will protrude from end plate 14. L-shaped frame 28 is then assembled onto the relay by forcibly inserting hole 43 over core end 48. (See FIG. 5). Hole 43 and core end 48 are dimensioned to allow a press fit between the components. Optionally, after the hole 43 of frame 28 is inserted over core end 48, a stake (not shown) is driven into core end 48 to spread it apart and further secure the frame to the relay. Alternatively, side 41 could be fastened to end plate 14 using any suitable fastening means such as screw or rivet assembly. With frame 28 assembled, side 42 substantially covers the adjacent side of insulator 20. An end view of the partially assembled relay (on the armature side of the relay) following assembly of frame 28 is shown in FIG. 4.

With continuing reference to FIG. 1, armature/contact assembly 30 is comprised of an armature 32 and a contact spring 35 which is fastened to the armature by, e.g. spin riveting. Contact spring 35 is of leaf spring material and includes a movable member 34 having a pair of electrical contacts 36*a,* 36*b* on opposing sides, an arcuate portion 37 which provides spring bias to the armature, and a mounting portion 39. Armature/contact assembly 30 is mounted to the intermediate relay assembly by inserting holes 44 over posts 31 of frame 28 and then spin riveting the posts. Concurrently, member 34 is inserted through an opening (not shown) of contact chamber 17.

Figure 6:
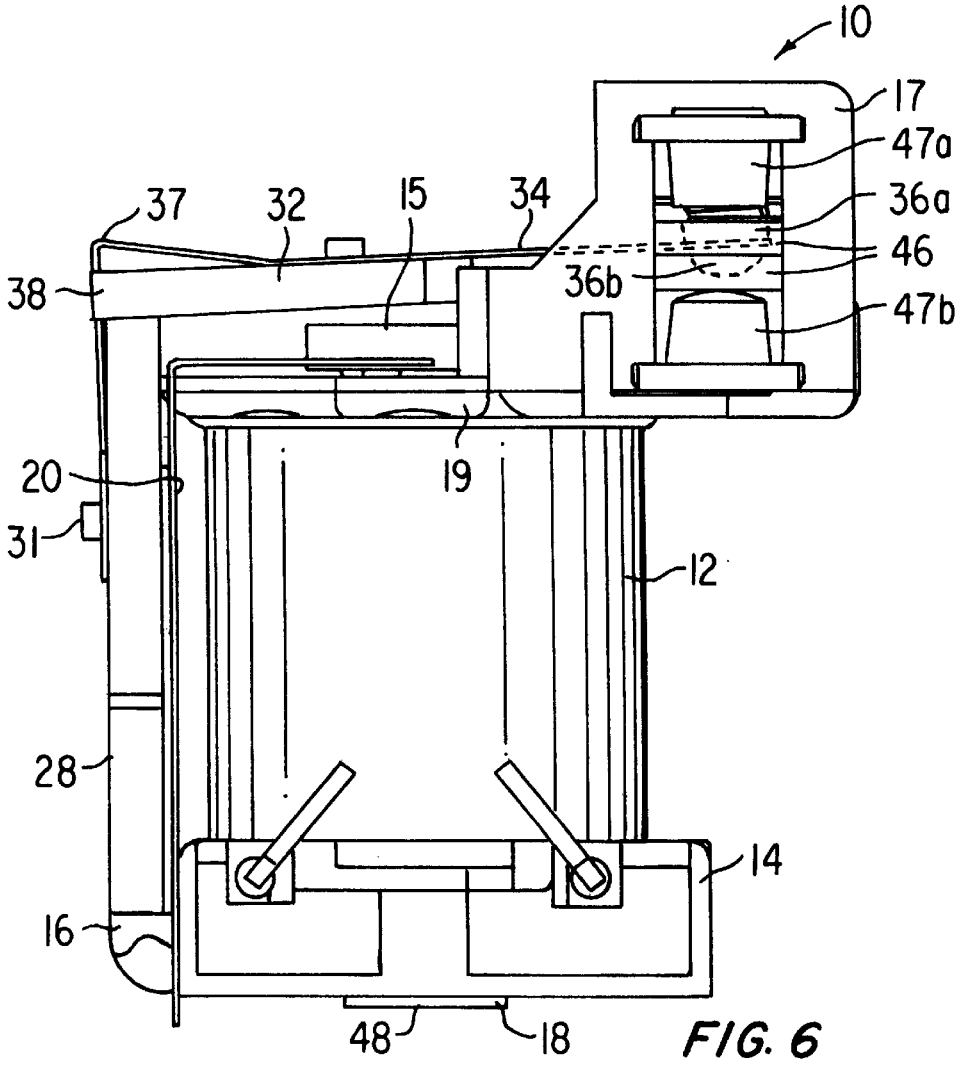
FIGS. 5 and 6 are perspective and top views, respectively, of a fully assembled relay in accordance with the invention.
Figure 5:
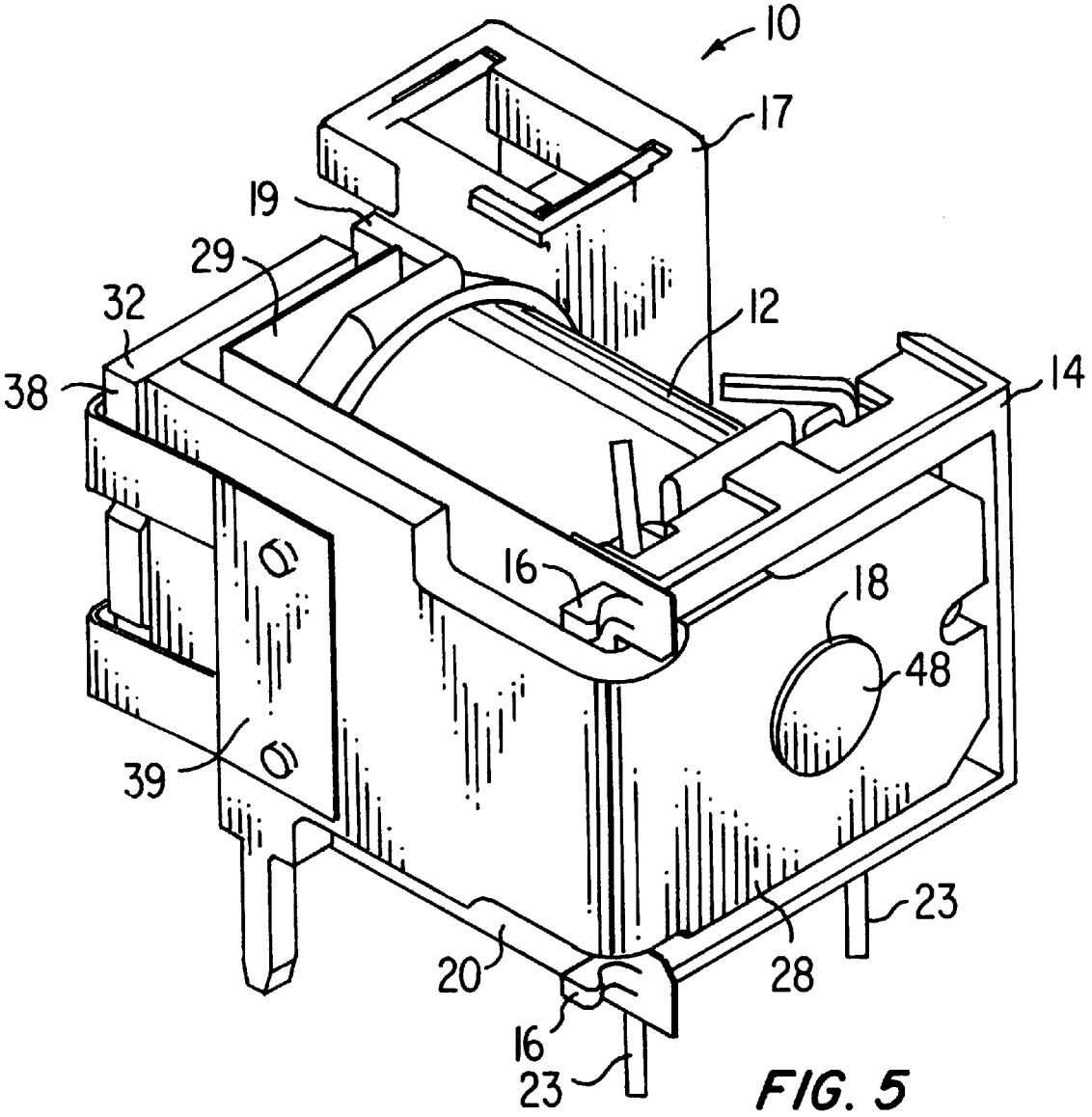

FIGS. 5 and 6 show perspective and top views, respectively, of the fully assembled relay 10. As seen in FIG. 6, with member 34 inserted within chamber 17, movable contacts 36*a,* 36*b* oppose stationary contacts 47*a*, 47*b,* respectively. Contacts 36*a,* 36*b* are below cross-member 46 of contact chamber 17. With no electromagnetic force produced by winding 12, the spring bias of spring contact 35 causes contacts 36*a* and 47*a* to electrically connect. A circuit is then completed between a contact terminal on armature 32 and a terminal within chamber 17 connected to contact 47*a* (both terminals not shown). With application of electromagnetic force by winding 12, armature 32 pivots about pivot edge 38, electrical connection of contacts 36*a,* 47*a* is broken, and electrical connection of contacts 36*b,* 47*b* is established. This completes a circuit between the terminal on armature 32 and another terminal (not shown) within chamber 17 connected to contact 47*b*.

Thus disclosed is a compact design for an electromagnetic relay that can be efficiently assembled and which provides a high degree of resilience to voltage breakdown between the coil (winding) and other electrically conductive components of the relay by virtue of the folded insulating sheet 20. The utilization of the pair of bobbin posts 16, the U-shaped slits 25 on the insulator and the core head 15 to trap the other side of the insulator advantageously provide for an efficient, cost-effective assembly of the relay. The disclosed relay 10 is particularly advantageous in a miniature size such as, e.g., on the order of one cubic inch. For a relay this size, the insulated sheet 20 is preferably composed of Mylar® and is the order of 0.2 mm thick.

It will be understood that the embodiments disclosed herein are merely exemplary and that one skilled in the art can make many modifications to the disclosed embodiments without departing from the spirit and scope of the invention. All such modifications and variations are intended to be included within the scope of the invention as defined by the appended claims.

What is claimed is:

1. An electromagnetic relay fabricated by the steps of:

providing a winding with an end plate associated therewith disposed at a first end of said winding;

anchoring a first side of a folded insulating sheet to said end plate and positioning a second side of said insulating sheet adjacent a second end of said winding;

inserting a magnetic core within said winding;

fastening a frame to said end plate, said frame covering a substantial portion of the first side of said insulating sheet; and fastening an armature to said frame, said armature abutting said second side of said insulating sheet and movable in response to electromagnetic force produced by said winding to cause at least one movable contact operably associated with said armature to move with respect to at least one stationary contact mounted in said relay.

2. The relay of claim 1, wherein said magnetic core has a cylindrical body of a first diameter and a disc-shaped head of a second, larger diameter, and further wherein said step of anchoring said insulating sheet is performed prior to inserting said magnetic core, and said head contacts the second side of said insulating sheet to trap it in place.

3. The relay of claim 1, wherein said end plate includes a plurality of posts extending from a side portion thereof, and further wherein said insulating sheet has a plurality of slits each associated with a respective said post, each said post extending through a respective slit to thereby create a flap on said insulating sheet that presses against said post and thereby anchors said first side of said insulating sheet to the side portion of said end plate.

4. The relay according to claim 1, wherein said at least one movable contact is disposed on a contact spring that is fastened to said armature, said contact spring bending around said armature and fastening to said frame.

5. The relay according to claim 1, further including a bobbin assembly comprising a bobbin, a contact chamber for housing said at least one stationary contact, an L-shaped bracket, and said end plate, wherein said winding is wound about said bobbin, said L shaped bracket has a first side unitary with a first end of said bobbin and a second side unitary with said contact chamber, said end plate is unitary with said bobbin at the opposing end of said winding, said first side of said bracket being between said second side of said insulating sheet and said first end of said winding.

6. The relay according to claim 1, wherein said frame is substantially L-shaped with a first side abutting a substantial portion of the first side of said insulating sheet, and with a second side of said frame fastened to said end plate.

* * * * *